US012357866B1

(12) United States Patent
Wu et al.

(10) Patent No.: US 12,357,866 B1
(45) Date of Patent: Jul. 15, 2025

(54) WEIGHT-ADJUSTABLE DUMBBELL

(71) Applicant: Wuyi Boda industry and trade Co., LTD., Jinhua (CN)

(72) Inventors: Zige Wu, Jinhua (CN); Mingkai Wu, Jinhua (CN)

(73) Assignee: Wuyi Boda industry and trade Co., LTD., Jinhua (CN)

( * ) Notice: Subject to any disclaimer, the term of this patent is extended or adjusted under 35 U.S.C. 154(b) by 0 days.

(21) Appl. No.: 18/925,050

(22) Filed: Oct. 24, 2024

(30) Foreign Application Priority Data

Sep. 30, 2024 (CN) ..... 202422398945.5

(51) Int. Cl.
*A63B 21/075* (2006.01)
*A63B 21/072* (2006.01)
*A63B 71/00* (2006.01)

(52) U.S. Cl.
CPC ..... *A63B 21/075* (2013.01); *A63B 21/0726* (2013.01); *A63B 21/0728* (2013.01); *A63B 71/0036* (2013.01)

(58) Field of Classification Search
CPC ..... A63B 21/0726; A63B 21/0728; A63B 71/0036; A63B 21/072–075
See application file for complete search history.

(56) References Cited

U.S. PATENT DOCUMENTS 1,438,804 A * 12/1922 Albizu ..... A63B 21/0726 482/108
2009/0239719 A1* 9/2009 Patti ..... A63B 21/0726 482/107
2017/0239510 A1* 8/2017 Wang ..... A63B 21/0724
2020/0147442 A1* 5/2020 Simonson ..... A63B 21/4043
2022/0176186 A1* 6/2022 Chen ..... A63B 21/075
2023/0293932 A1* 9/2023 Chang ..... A63B 21/0726 482/107
2023/0347198 A1* 11/2023 Hong ..... A63B 21/0728

* cited by examiner

*Primary Examiner* — Loan B Jimenez
*Assistant Examiner* — Catrina A Letterman
(74) *Attorney, Agent, or Firm* — Ying-Ting Chen

(57) ABSTRACT

A weight-adjustable dumbbell includes a plurality of dumbbell plates; abase for holding the dumbbell plates; a positioning shaft; a handle movably sleeved on the positioning shaft; a plurality of cam structures disposed on two ends of the handle respectively; and a driving plate disposed between the handle and the cam structures, where the handle drives the plurality of cam structures to rotate on the positioning shaft through the driving plate; where two ends of the positioning shaft are respectively provided with a control device, the control device is connected to the cam structure to control the cam structure rotating relatively with the dumbbell plates.

17 Claims, 6 Drawing Sheets

WEIGHT-ADJUSTABLE DUMBBELL

CROSS-REFERENCE TO RELATED APPLICATIONS

This application claims priority to Chinese Patent Application No. 202422398945.5, filed on Sep. 30, 2024, which claims priority to Chinese Patent Application No. 202421107419.2, filed on May 21, 2024, the contents of which are incorporated herein by reference in their entirety.

TECHNICAL FIELD

The present disclosure relates to the technical field of a dumbbell, more particularly to a weight-adjustable dumbbell.

BACKGROUND

The related art discloses a weight-adjustable dumbbell, including a plurality of dumbbell plates, a dumbbell rod assembly for hanging and connecting the dumbbell plates, and a bottom supporter for storing the dumbbell plates. The dumbbell rod assembly includes a transmission shaft, a plurality of cam structures are fixedly connected to the transmission shaft, the cam structure comprises a cam plate, the cam plate comprises a load-bearing layer for hanging with the dumbbell plates, the outer layers on two sides of the load-bearing layer are respectively provided with anti-wear layers, and the outer surface of the anti-wear layer on one side is provided with a plurality of protruding points. Two sides of the cam plate of the cam structure are provided with anti-wear layers, and the outer surface of the anti-wear layer on one side is provided with protruding points, the hardness of the anti-wear layer is lower than that of the dumbbell plate, so that the wear of the cam plate on the dumbbell plate can be effectively reduced, the service life of the dumbbell plate can be prolonged, and the connection stability of the dumbbell plate can be improved. In the related art, the weight of the dumbbell is adjusted by a scale rotating plate driving a driving shaft to rotate, and the handle does not rotate with the driving shaft, so it might be more labor-saving and does not need to be operated with two hands at the same time to realize the adjustment, so it might be more convenient to use.

SUMMARY

According to the embodiment of the present disclosure, a weight-adjustable dumbbell is provided, comprising a plurality of dumbbell plates and a base for holding the dumbbell plates, and further comprising:

a positioning shaft, where a handle is movably sleeved on the positioning shaft, two ends of the handle are respectively provided with a plurality of cam structures, a driving plate is disposed between the handle and the cam structures, and the handle drives the plurality of cam structures to rotate on the positioning shaft through the driving plate;

a cam structure, where one side of the cam structure is provided with a first connecting neck, the first connecting neck comprises a first supporting portion and a first connecting portion, an outer contour of the first connecting portion is a polygonal structure, and an inner contour of the first connecting portion is a circular structure; where the other side of the cam structure is provided with a first polygonal connecting slot;

a driving plate, where one side of the driving plate close to the cam structure is provided with a second polygonal connecting slot capable of being engaged with the polygonal structure of the first connecting portion; and a positioning shaft, where two ends of the positioning shaft are respectively provided with a control device, the control device is connected to the cam structure to control the cam structure rotating relatively with the dumbbell plate.

Further, the control device comprises a gear ring assembly, a spring-control block, a bridge block, and a first fixing plate;

where the gear ring assembly is sleeved at two ends of the positioning shaft and connected to the cam structure;

the spring-control block is disposed at a lower end of the gear ring assembly for locking the gear ring assembly;

the first fixing plate is rotatably sleeved at one end of the handle; and one end of the bridge block is fixedly connected to the gear ring assembly, and the other end is fixedly connected to the first fixing plate.

Further, the gear ring assembly comprises an inner fixing plate, a gear ring, a gear ring fixing plate, a pair of first elastic pins, and an outer fixing plate;

where a pair of first limiting slots and a first annular protrusion are disposed on the inner fixing plate, a first opening is disposed on one side of the first limiting slot close to a center of the circle, and a circular limiting slot is formed in the first annular protrusion;

where the gear ring fixing plate is rotatably connected to the inner fixing plate, the side of the gear ring fixing plate close to the cam structure is provided with a second connecting neck, the second connecting neck comprises a second supporting portion and a second connecting portion, an outer contour of the second connecting portion is a regular polygon and an inner contour of the second connecting portion is a circle, and the inner fixing plate is rotatably sleeved on the second supporting portion;

where the gear ring is disposed in the circular limiting slot and is fixedly connected to the gear ring fixing plate, an outer circumference of the gear ring is sequentially provided with a plurality of outer recesses, and an inner circumference of the gear ring is sequentially provided with a plurality of inner recesses;

where a pair of first elastic pins are respectively disposed in the pair of first limiting slots and each protruded from the corresponding first opening to be in contact with the outer recesses and the spring-control block is capable of being snapped with the inner recess;

where the outer fixing plate is connected to the inner fixing plate, a bottom of the outer fixing plate is provided with a second limiting slot, and the spring-control block is movably disposed in the second limiting slot.

Further, the weight-adjustable dumbbell further comprises an indicating plate and a pointer;

where the indicating plate is disposed between the first fixing plate and the handle and rotates with the handle, and the indicating plate is provided with weight marks; and where one end of the pointer is snapped with the first fixing plate and the other end is snapped with the outer fixing plate for indicating the weight mark on the indicating plate.

Further, the bridge block is provided with a first positioning slot and the pointer is disposed in the first positioning slot.

Further, an end portion of the positioning shaft is sequentially provided with a first shaft body and a second shaft body, where a diameter of the first shaft body is smaller than a diameter of the positioning shaft, and a diameter of the second shaft body is smaller than the diameter of the first shaft body, a second annular protrusion is disposed in an inner side of the outer fixing plate, a third annular protrusion is disposed in the second annular protrusion, the second annular protrusion is rotatably connected to the positioning shaft, and the third annular protrusion is rotatably connected to the first shaft body.

Further, the weight-adjustable dumbbell further comprises a nut, the outer fixing plate is provided with a third limiting slot, the second shaft body is provided with a thread, and the nut is disposed in the third limiting slot and threaded with the second shaft body.

Further, the weight-adjustable dumbbell further comprises a sealing cap for sealing the third limiting slot.

Further, two ends of the base are respectively provided with a protrusion, the protrusion corresponds to the spring-control block for jacking up the spring-control block.

The present disclosure has the beneficial effects that the handle directly drives the cam structure to rotate through the driving plate, and the torque is reduced without the rotation of the positioning shaft, so that the operation is more convenient. With the limiting gear ring and elastic snapping pin, the user can clearly feel feedback every time the handle is rotated for several angles, and the use experience is better. It ensures that the handle can only stay at the position corresponding to the scale during the rotation process, to avoid the risk of staying in the middle and solve the safety problem caused by the dumbbell plate falling off during use by the user.

It is to be understood that the foregoing general description and the following detailed description are exemplary and are intended to provide further illustration of the claimed technology.

DETAILED DESCRIPTION OF THE EMBODIMENTS

Figure 1:
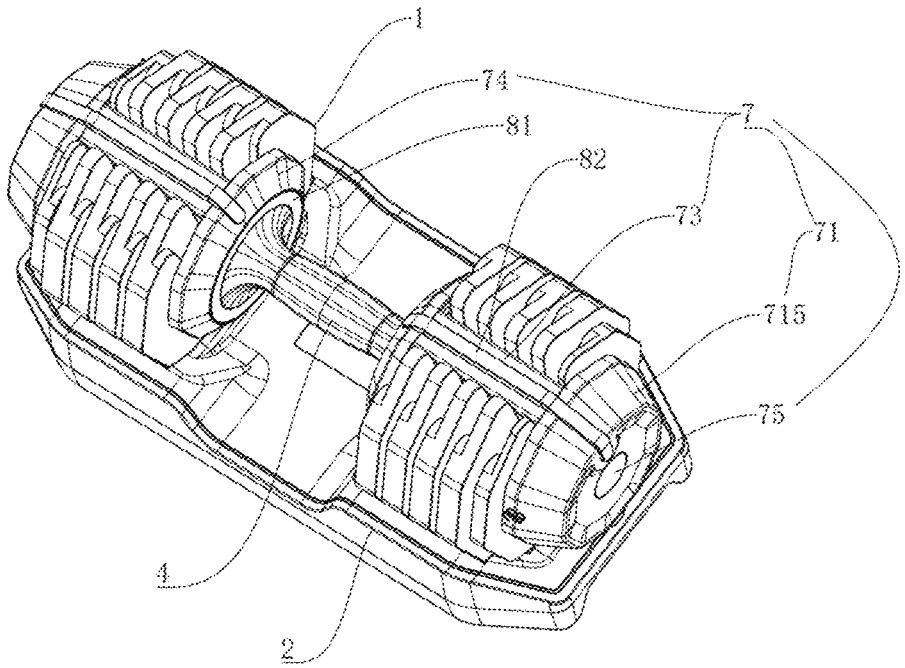
FIG. 1 is a perspective view according to an embodiment of the present disclosure.
Figure 2:
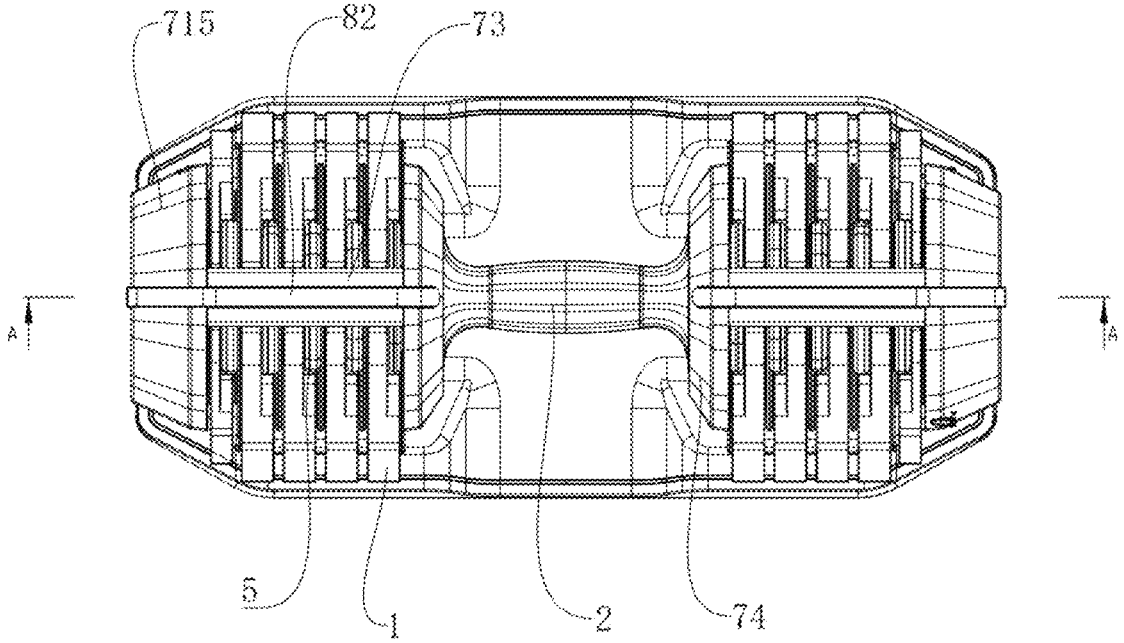
FIG. 2 is a front view according to the embodiment of the present disclosure.

The following will be combined with the accompanying drawings, the embodiment of the present disclosure will be described in detail, and the present disclosure will be further illustrated.

First, the weight-adjustable dumbbell according to the embodiment of the present disclosure will be described in conjunction with FIGS. 1 to 11, which is used in the fitness field with wide application scenarios.

As shown in FIGS. 1 to 11, the weight-adjustable dumbbell of the embodiment of the present disclosure comprises a plurality of dumbbell plates 1 and a base 2 for holding the dumbbell plates 1, each of the dumbbell plates 1 provided with a hanging slot 11, and the weight-adjustable dumbbell further comprises:

- a positioning shaft 3, where a handle 4 is movable sleeve on the positioning shaft 3, two ends of the handle 4 are respectively provided with a plurality of cam structures 5, a driving plate 6 is disposed between the handle 4 and the cam structures 5, the handle 4 drives a plurality of cam structures 5 to rotate on the positioning shaft 3 through the driving plate 6, the number of dumbbell plates 1 lifted is different through different rotation angles of the plurality of cam structures 5, and each of the cam structure 5 has a different cam contour;
- a cam structure 5, where one side of the cam structure 5 is provided with a first connecting neck 51, the first connecting neck 51 comprises a first supporting portion 511 and a first connecting portion 512, the outer contour of the first connecting portion 512 is a polygonal structure and the inner contour is a circular structure, the other side of the cam structure 5 is provided with a first polygonal connecting slot 52, the adjacent cam structures 5 can be coupled and connected by corresponding first connecting portions 512 and first polygonal connecting slots 52;
- a driving plate 6, where the side of the driving plate 6 close to the cam structure 5 is provided with a second polygonal connection slot 61 to be coupled with the polygonal structure of the first connecting portion 512, one side of the driving plate 6 is fixedly connected to the handle 4, and the other side is coupled and connected with the first connecting portion 512 of the adjacent cam structure 5 through the second polygonal connection slot 61;
- a control device 7, where two ends of the positioning shaft 3 are respectively provided with the control device 7, the control device 7 is connected to the cam structure 5 to control the cam structure 5 rotating relatively with the dumbbell plate 1.

Specifically, in the embodiment, the thickness of the dumbbell plate 1 is adjustable, different thicknesses of the dumbbell plate 1 represent different weights, the width of the first supporting portion 511 can be adjusted according to the thickness of the dumbbell plate 1, and the width of the first supporting portion 511 of the cam structure 5 directly connected to the driving plate 6 can be 0.

Further, as shown in FIGS. 1 to 10, in the present embodiment, the control device 7 comprises a gear ring assembly 71, a spring-control block 72, a bridge block 73, and a first fixing plate 74.

The gear ring assembly 71 is sleeved at two ends of the positioning shaft 3 and connected to the cam structure 5.

The spring-control block 72 is provided at the lower end of the gear ring assembly 71 for locking the gear ring assembly 71.

The first fixing plate 74 is rotatably sleeved on one end of the handle 4.

The bridge block 73 is disposed in the opening of the dumbbell plate 1, one end is fixedly connected to the gear ring assembly 71, and the other end is fixedly connected to the first fixing plate 74, so as to prevent relative rotation between the cam structure 5 and the dumbbell plate 1 when lifting up the handle 4 and to prevent the dumbbell plate 1 from falling.

Further, as shown in FIGS. 1 to 10, in the present embodiment, the gear ring assembly 71 comprises an inner fixing plate 711, a gear ring 712, a gear ring fixing plate 713, a pair of first elastic pins 714, and an outer fixing plate 715.

The inner fixing plate 711 is provided with a pair of first limiting slots 7111 and a first annular protrusion 7112. A first opening 71110 is provided on the side of the first limiting slot 7111 close to the center of the inner fixing plate 711. A circular limiting slot 71120 is formed in the first annular protrusion 7112.

The gear ring fixing plate 713 is rotatably connected to the inner fixing plate 711, the side of the gear ring fixing plate 713 close to the cam structure 5 is provided with a second connecting neck 7131, the second connecting neck 7131 comprises a second supporting portion 71311 and a second connecting portion 71312, the outer contour of the second connecting portion 71312 is a regular polygon and the inner contour is a circle, the second connecting portion 71312 is coupled and connected with the first polygonal connecting slot 52 of the adjacent cam structure 5, and the gear ring fixing plate 713 can rotate with the adjacent cam structure 5. The inner fixing plate 711 is rotatably sleeved on the second supporting portion 71311, and the gear ring fixing plate 713 can rotate relatively with the inner fixing plate 711.

The gear ring 712 is disposed in the circular limiting slot 71120 formed in the first annular protrusion 7112 and is fixedly connected to the gear ring fixing plate 713, the outer circumference of the gear ring 712 is sequentially provided with a plurality of outer recesses 7121, and the inner circumference of the gear ring 712 is sequentially provided with a plurality of inner recesses 7122.

The pair of first elastic pins 714 are respectively disposed in the pair of first limiting slots 7111, protruded from corresponding first openings 71110, and can be in contact with the outer recesses 7121. In a case where the gear ring 712 rotates, the vibration occurs between the first elastic pins 714 and the outer recesses 7121, thereby sensing whether the rotation is in place or not.

The spring-control block 72 can be snapped with the inner recess 7122, and when the handle 4 is lifted up, the spring-control block 72 is snapped with the inner recess 7122, and the gear ring fixing plate 713 cannot rotate relatively with the outer fixing plate 715. When the handle 4 is lowered, the protrusion on the base 2 pushes up the corresponding spring-control block 72, the spring-control block 72 is disengaged from the inner recess 7122, and the gear ring fixing plate 713 and the outer fixing plate 715 can rotate relatively, thereby realizing weight adjustment.

The outer fixing plate 715 and the inner fixing plate 711 are fixedly connected by screws, the bottom of the outer fixing plate 715 is provided with a second limiting slot 7151, and the spring-control block 72 is movably disposed in the second limiting slot 7151.

Figure 11:
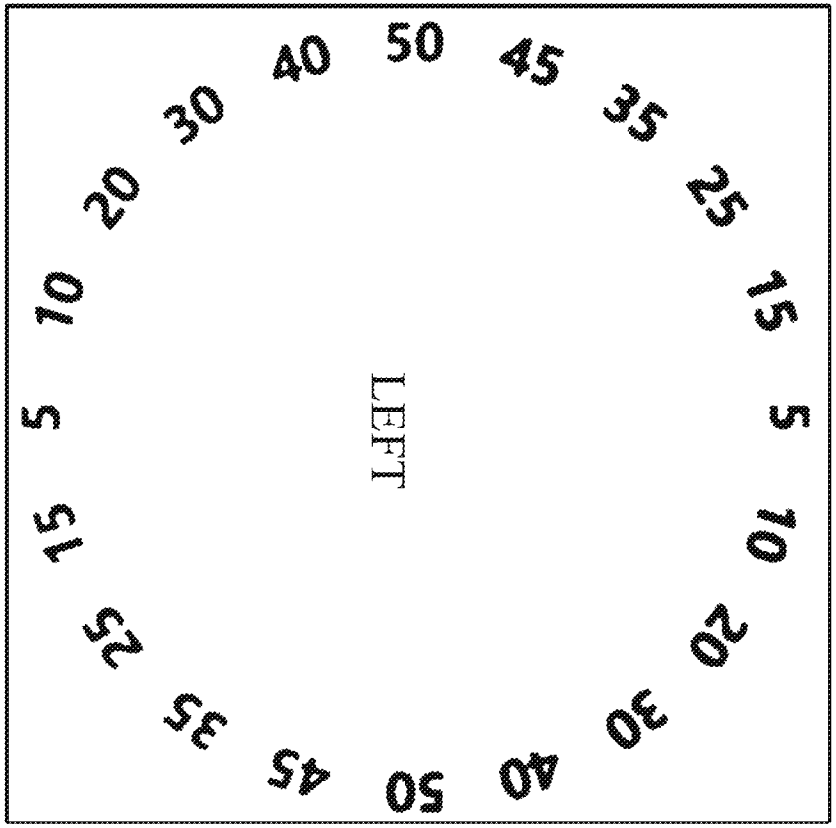
FIG. 11 is a schematic view of the number distribution on the indicating plate according to the embodiment of the present disclosure.

Further, as shown in FIGS. 1 and 11, the present embodiment further comprises an indicating plate 81 and a pointer 82.

The indicating plate 81 is disposed between the first fixing plate 74 and the handle 4, and rotates with the handle 4. The indicating plate 81 is provided with weight marks.

One end of the pointer 82 is snapped with the first fixing plate 74 and the other end is snapped with the outer fixing plate 715 for indicating the weight mark on the indicating plate 81.

Figure 10:
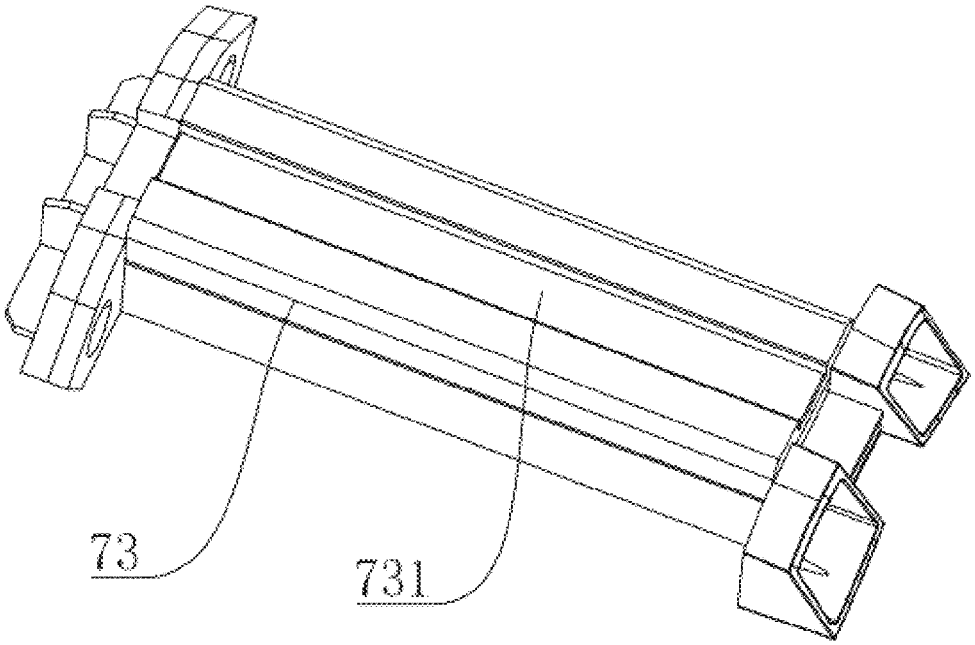
FIG. 10 is a schematic structural view of the bridge block according to the embodiment of the present disclosure.

Further, as shown in FIGS. 1 and 10, in the present embodiment, the bridge block 73 is provided with a first positioning slot 731. The pointer 82 is provided in the first positioning slot 731 for limiting the position of the pointer 82.

Figure 4:
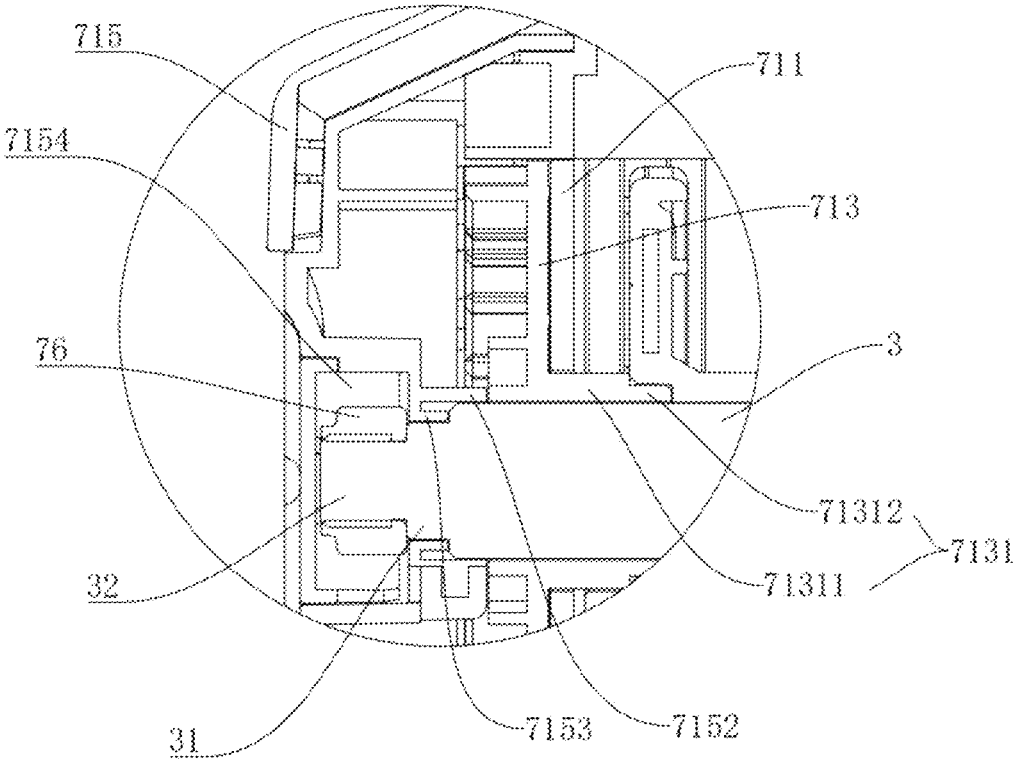
FIG. 4 is an enlarged view of part A of FIG. 3.
Figure 5:
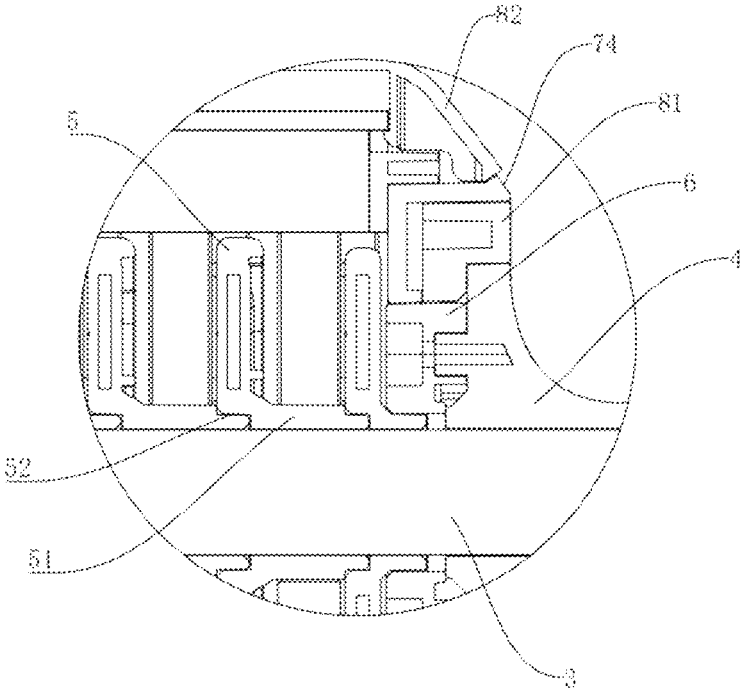
FIG. 5 is an enlarged view of part B of FIG. 3.
Figure 6:
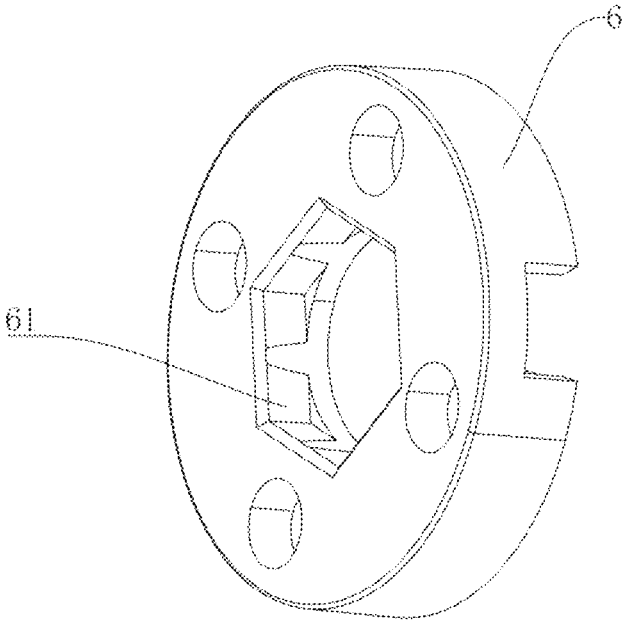
FIG. 6 is a schematic structural view of the driving plate according to the embodiment of the present disclosure.
Figure 7:
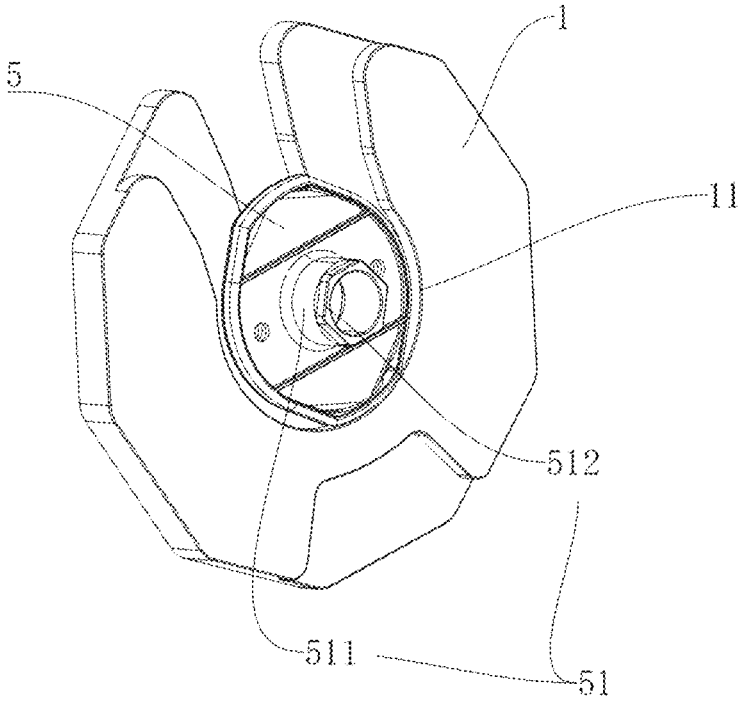
FIG. 7 is a schematic structural view of engaging the dumbbell plate and the cam structure according to the embodiment of the present disclosure.
Figure 8:
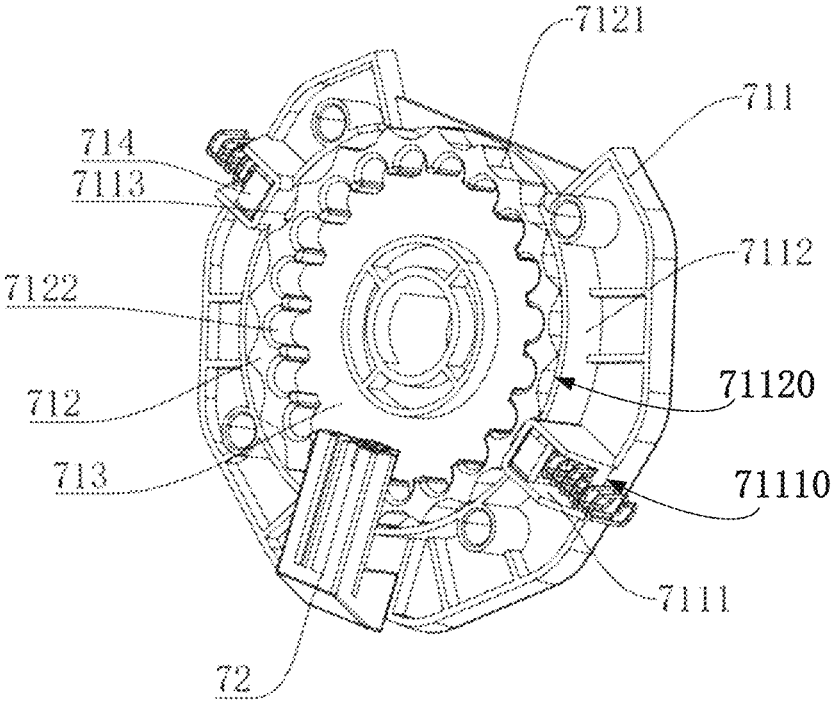
FIG. 8 is a schematic structural view of the gear ring assembly according to the embodiment of the present disclosure after removing the outer fixing plate.
Figure 9:
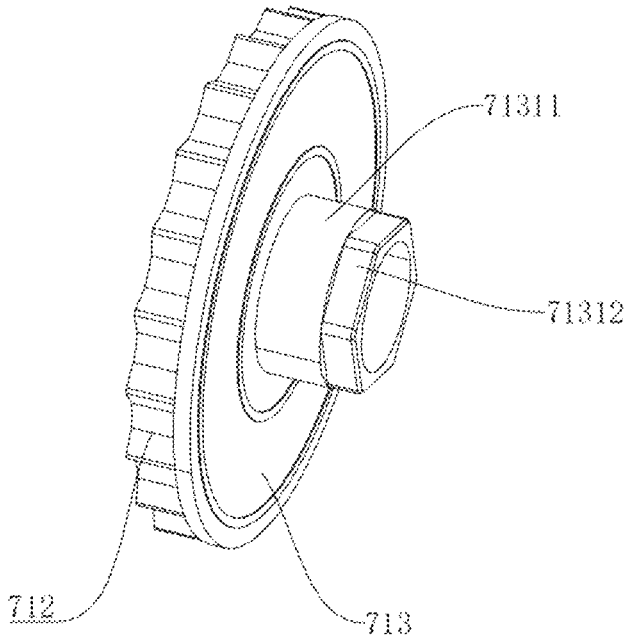
FIG. 9 is a schematic structural view of engaging the gear ring and the gear ring fixing plate according to the embodiment of the present disclosure.

Further, as shown in FIG. 4, in the present embodiment, the end portion of the positioning shaft 3 is sequentially provided with a first shaft body 31 and a second shaft body 32, the diameter of the first shaft body 31 is smaller than the diameter of the positioning shaft 3, and the diameter of the second shaft body 32 is smaller than the diameter of the first shaft body 31. A second annular protrusion 7152 is disposed inside the outer fixing plate 715, and a third annular protrusion 7153 is disposed inside the second annular protrusion 7152, the second annular protrusion 7152 is rotatably connected to the positioning shaft 3, and the third annular protrusion 7153 is rotatably connected to the first shaft body 31, so as to prevent the outer fixing plate 715 from moving inward in the axial direction.

Figure 3:
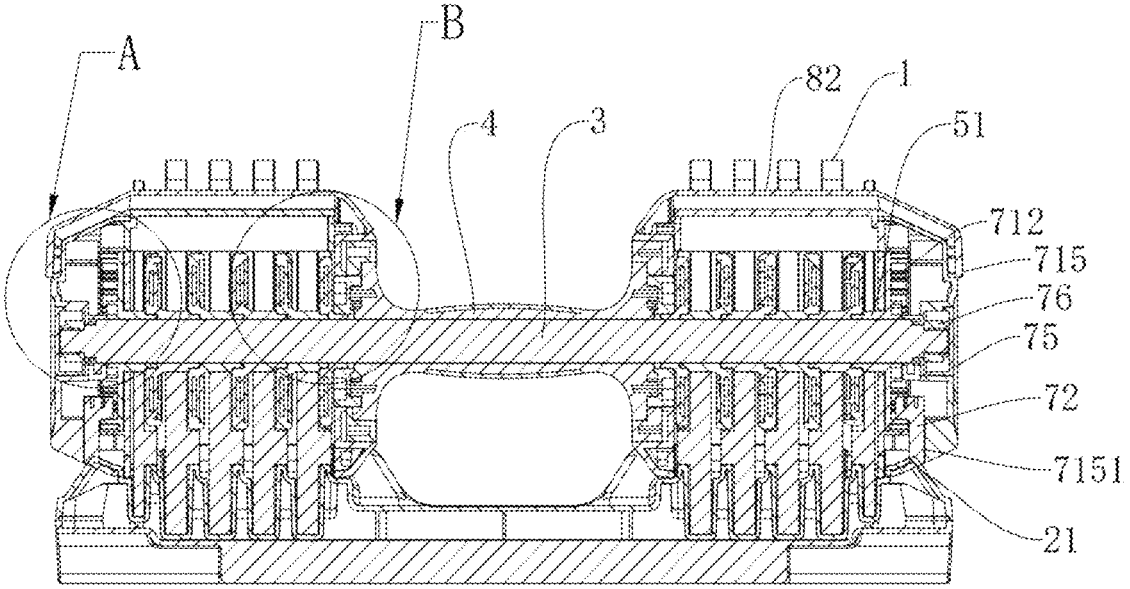
FIG. 3 is a cross-sectional view taken along line A-A of FIG. 2.

Further, as shown in FIGS. 3 to 4, the present embodiment further comprises a nut 76. The outer fixing plate 715 is provided with a third limiting slot 7154, the second shaft body 32 is provided a thread. The nut 76 is disposed in the third limiting slot 7154, is screwed and connected to the second shaft body 32 for fixing the outer fixing plate 715, and is further easily disconnected by the screw.

Further, as shown in FIGS. 1, 3, and 4, the present embodiment further comprises a sealing cap 75 for sealing the third limiting slot 7154.

Further, as shown in FIG. 3, in the embodiment, two ends of the base 2 are respectively provided with a protrusion 21, and the protrusion 21 and the spring-control block 72 correspond to each other for jacking up the spring-control block 72.

Working principle: in a case where the dumbbell is placed on the base 2, the protrusion 21 on the base 2 jacks up the corresponding spring-control block 72, the spring-control block 72 is disengaged from the inner recess 7122, and the gear ring fixing plate 713 can rotate relatively with the outer fixing plate 715. At this time, the handle 4 is rotated to drive the driving plate 6, the cam structure 5, the gear ring 712, and the gear ring fixing plate 713 to rotate together, and the dumbbell plate 1 is fixed on the base 2 without rotation. Thus, with the handle 4 having different rotation angles, the number of dumbbell plates 1 lifted by the cam structure 5 is different, so as to adjust the weight. On the contrary, in a case where the dumbbell is disengaged from the base 2, the spring-control block 72 is snapped into the inner recess 7122, and the gear ring fixing plate 713 cannot rotate relatively with the outer fixing plate 715. At this time, the handle 4 is rotated to drive the driving plate 6, the cam structure 5, the gear ring 712, the gear ring fixing plate 713, the inner fixing plate 711, the outer fixing plate 715, the bridge block 73, and the first fixing plate 74 to rotate together. The bridge block 73 drives the dumbbell plate 1 to rotate synchronously, so as to prevent the dumbbell plate 1 from falling.

As mentioned above, as shown in FIGS. 1 to 11, a weight-adjustable dumbbell according to the embodiment of the present disclosure is disclosed. The handle directly drives the cam structure to rotate through the driving plate, and the torque is reduced without the rotation of the positioning shaft, so that the operation is more convenient. With the limiting gear ring and elastic snapping pin, the user can clearly feel feedback every time the handle is rotated for several angles, and the use experience is better. It ensures that the handle can only stay at the position corresponding to the scale during the rotation process, to avoid the risk of staying in the middle and solve the safety problem caused by the dumbbell plate falling off during use by the user.

It should be noted that in the description, the terms "comprises", "comprising" or any other variation thereof are intended to encompass a non-exclusive inclusion such that a process, method, article, or device that comprises a series of elements comprises not only those elements, but further other elements that are not explicitly listed, or elements inherent to such a process, method, article, or device. Without further limitation, an element defined by the statement "comprising" does not preclude the presence of additional identical elements in a process, method, article, or device that comprises the element.

Although the contents of the present disclosure have been described in detail by way of the above-described embodiments, it should be recognized that the above description should not be regarded as limiting the present disclosure. Various modifications and alternatives to the present disclosure will be apparent to those skilled in the art after reading the foregoing. Therefore, the scope of protection of the present disclosure should be defined by the appended claims.

What is claimed is:

1. A weight-adjustable dumbbell, comprising:

a plurality of dumbbell plates;

a base for holding the plurality of dumbbell plates;

a positioning shaft;

a handle, movably sleeved on the positioning shaft;

a plurality of cam structures, disposed on two ends of the handle respectively; and two driving plates, disposed between the handle and the plurality of cam structures on the two ends of the handle respectively, wherein the handle drives the plurality of cam structures to rotate on the positioning shaft through the two driving plates;

wherein one side of one of the plurality of cam structures is provided with a first connecting neck, the first connecting neck comprises a first supporting portion and a first connecting portion, an outer contour of the first connecting portion is a polygonal structure, an inner contour of the first connecting portion is a circular structure, and the other side of the one of the plurality of cam structures is provided with a first polygonal connecting slot;

wherein one side of each of the two driving plates close to the plurality of cam structures is provided with a second polygonal connecting slot capable of being engaged with the polygonal structure of the first connecting portion;

wherein two ends of the positioning shaft are respectively provided with a control device, the control device on each end of the positioning shaft is connected to the plurality of cam structures to control the plurality of cam structures rotating relatively with the plurality of dumbbell plates;

wherein each of the control devices comprises a gear ring assembly, a spring-control block, a bridge block, and a first fixing plate;

wherein for each of the control devices:

the gear ring assembly is sleeved on a respective end of the positioning shaft and connected to one of the plurality of cam structures;

the spring-control block is disposed at a lower end of the gear ring assembly for locking the gear ring assembly;

the first fixing plate is rotatably sleeved at a respective end of the handle; and one end of the bridge block is fixedly connected to the gear ring assembly, and the other end of the bridge block is fixedly connected to the first fixing plate;

wherein the gear ring assembly comprises an inner fixing plate, a gear ring, and a gear ring fixing plate;

the inner fixing plate is provided with a pair of first limiting slots and a first annular protrusion, one side of the first limiting slot close to a center of the inner fixing plate is provided with a first opening, and a circular limiting slot is formed in the first annular protrusion;

the gear ring fixing plate is rotatably connected to the inner fixing plate, one side of the gear ring fixing plate close to the plurality of cam structures is provided with a second connecting neck, the second connecting neck comprises a second supporting portion and a second connecting portion, an outer contour of the second connecting portion is a regular polygon and an inner contour of the second connecting portion is a circle, and the inner fixing plate is rotatably sleeved on the second supporting portion; and the gear ring is disposed in the circular limiting slot and fixedly connected to the gear ring fixing plate, an outer circumference of the gear ring is sequentially provided with a plurality of outer recesses, and an inner circumference of the gear ring is sequentially provided with a plurality of inner recesses.

2. The weight-adjustable dumbbell according to claim 1, wherein the gear ring assembly of each of the control devices comprises a pair of first elastic pins and an outer fixing plate;

wherein for each of the control devices:

the pair of first elastic pins are respectively disposed in the pair of first limiting slots and each protruded from the first opening correspondingly to be in contact with the plurality of outer recesses and the spring-control block is capable of being snapped with the plurality of inner recesses; and the outer fixing plate is connected to the inner fixing plate, a bottom of the outer fixing plate is provided with a second limiting slot, and the spring-control block is movably disposed in the second limiting slot.

3. The weight-adjustable dumbbell according to claim 2, further comprising: an indicating plate and a pointer;

wherein the indicating plate is disposed between the first fixing plate of a respective control device and the handle and rotates with the handle, and the indicating plate is provided with weight marks; and one end of the pointer is snapped with the first fixing plate of the respective control device and the other end of the pointer is snapped with the outer fixing plate of the respective control device for indicating one of the weight marks on the indicating plate.

4. The weight-adjustable dumbbell according to claim 3, wherein the bridge block of the respective control device is provided with a first positioning slot and the pointer is disposed in the first positioning slot.

5. The weight-adjustable dumbbell according to claim 4, wherein two ends of the base are respectively provided with a protrusion corresponding to the spring-control block of a respective control device for jacking up the spring-control block.

6. The weight-adjustable dumbbell according to claim 3, wherein two ends of the base are respectively provided with a protrusion corresponding to the spring-control block of a respective control device for jacking up the spring-control block.

7. The weight-adjustable dumbbell according to claim 2, wherein an end portion of the positioning shaft is sequentially provided with a first shaft body and a second shaft body, a diameter of the first shaft body is smaller than a diameter of the positioning shaft, and a diameter of the second shaft body is smaller than the diameter of the first shaft body.

8. The weight-adjustable dumbbell according to claim 7, wherein for each of the control devices wherein a second annular protrusion is disposed in an inner side of the outer fixing plate, a third annular protrusion is disposed in the second annular protrusion, the second annular protrusion is rotatably connected to the positioning shaft, and the third annular protrusion of a respective control device is rotatably connected to the first shaft body.

9. The weight-adjustable dumbbell according to claim 7, further comprising a nut;

wherein the outer fixing plate of each of the control devices is provided with a third limiting slot, the second shaft body is provided with a thread, and the nut is provided in the third limiting slot of a respective control device and threaded with the second shaft body.

10. The weight-adjustable dumbbell according to claim 9, further comprising a sealing cap for sealing the third limiting slot of the respective control device.

11. The weight-adjustable dumbbell according to claim 7, wherein two ends of the base are respectively provided with a protrusion corresponding to the spring-control block of a respective control device for jacking up the spring-control block.

12. The weight-adjustable dumbbell according to claim 2, wherein two ends of the base are respectively provided with a protrusion corresponding to the spring-control block of a respective control device for jacking up the spring-control block.

13. The weight-adjustable dumbbell according to claim 1, wherein an end portion of the positioning shaft is sequentially provided with a first shaft body and a second shaft body, a diameter of the first shaft body is smaller than a diameter of the positioning shaft, and a diameter of the second shaft body is smaller than the diameter of the first shaft body.

14. The weight-adjustable dumbbell according to claim 13, further comprising a nut;

wherein the outer fixing plate of each of the control devices is provided with a third limiting slot, the second shaft body is provided with a thread, and the nut is provided in the third limiting slot of a respective control device and threaded with the second shaft body.

15. The weight-adjustable dumbbell according to claim 14, further comprising a sealing cap for sealing the third limiting slot of the respective control device.

16. The weight-adjustable dumbbell according to claim 13, wherein two ends of the base are respectively provided with a protrusion corresponding to the spring-control block of a respective control device for jacking up the spring-control block.

17. The weight-adjustable dumbbell according to claim 1, wherein two ends of the base are respectively provided with a protrusion corresponding to the spring-control block of a respective control device for jacking up the spring-control block.

* * * * *